US010363467B2

(12) United States Patent
Brandenburg

(10) Patent No.: US 10,363,467 B2
(45) Date of Patent: Jul. 30, 2019

(54) TETHERABLE GOLF TEE AND TEEING SYSTEM

(71) Applicant: Jefferey Frederick Brandenburg, Gilbert, AZ (US)

(72) Inventor: Jefferey Frederick Brandenburg, Gilbert, AZ (US)

( * ) Notice: Subject to any disclaimer, the term of this patent is extended or adjusted under 35 U.S.C. 154(b) by 0 days.

(21) Appl. No.: 16/109,692

(22) Filed: Aug. 22, 2018

(65) Prior Publication Data

US 2018/0361213 A1 Dec. 20, 2018

Related U.S. Application Data

(63) Continuation-in-part of application No. 15/485,459, filed on Apr. 12, 2017, now abandoned.

(60) Provisional application No. 62/326,771, filed on Apr. 24, 2016.

(51) Int. Cl.
*A63B 57/12* (2015.01)
*A63B 71/02* (2006.01)

(52) U.S. Cl.
CPC ..... *A63B 57/12* (2015.10); *A63B 2071/024* (2013.01)

(58) Field of Classification Search
CPC ..... A63B 57/12; A63B 57/10
See application file for complete search history.

(56) References Cited

U.S. PATENT DOCUMENTS 1,551,003 A * 8/1925 Bennion ..... A63B 57/10 473/394
1,627,012 A * 5/1927 Copeland ..... A63B 57/10 473/394
1,696,136 A * 12/1928 Coburn ..... A63B 57/10 473/401
1,736,583 A * 11/1929 Deike ..... A63B 57/10 473/396
1,783,733 A * 12/1930 Manassero ..... A63B 57/12 473/396
2,668,710 A * 2/1954 Carlson ..... A63B 57/12 473/393
3,254,890 A * 6/1966 Watson ..... A63B 57/10 473/396
4,114,878 A * 9/1978 Hammond ..... A63B 57/12 473/394
4,336,940 A * 6/1982 Sprague ..... A63B 57/12 473/393

(Continued)

FOREIGN PATENT DOCUMENTS

DE 10232126 C1 * 8/2003 ..... A63B 57/16
DE 202014103732 U1 * 8/2014 ..... A63B 57/12

(Continued)

*Primary Examiner* — Steven B Wong

(57) ABSTRACT

A tetherable golf tee and teeing system are disclosed herein. One golf tee includes a body including a first end for inserting into an external surface and a second end opposite the first end and a crown located on the second end, the crown configured for resting a golf ball thereon. The body further includes a hollow portion and a first aperture located between the first end and the second end to access the hollow portion and for tethering the golf tee to another object. The crown includes a second aperture to further access the hollow portion. A golf tee system includes at least two of the above golf tees tethered together via a tethering apparatus.

17 Claims, 3 Drawing Sheets

(56) References Cited

U.S. PATENT DOCUMENTS

| | | | | | |
|---|---|---|---|---|---|
| 5,221,090 | A * | 6/1993 | Hong | A63B 57/10 | 473/391 |
| 5,820,490 | A * | 10/1998 | Hronas | A63B 57/12 | 473/391 |
| 2002/0123396 | A1* | 9/2002 | Joo | A63B 57/12 | 473/393 |
| 2008/0064532 | A1* | 3/2008 | Lee | A63B 57/203 | 473/396 |
| 2011/0092316 | A1* | 4/2011 | Chiang Huang | A63B 57/16 | 473/391 |

FOREIGN PATENT DOCUMENTS

| | | | | | |
|---|---|---|---|---|---|
| GB | 290906 | A * | 5/1928 | A63B 57/12 | |
| GB | 407171 | A * | 3/1934 | A63B 57/12 | |
| GB | 483599 | A * | 4/1938 | A63B 57/12 | |
| KR | 20090114854 | A * | 11/2009 | G09F 23/00 | |

* cited by examiner

TETHERABLE GOLF TEE AND TEEING SYSTEM

REFERENCE TO RELATED APPLICATION

The present application is a Continuation-In-Part of and claims priority to U.S. patent application Ser. No. 15/485,459, filed on Apr. 12, 2017, which claims priority to U.S. Provisional Patent Application No. 62/326,771, filed on Apr. 24, 2016, each of which is incorporated herein by reference, in their entirety.

FIELD

The present disclosure relates to golf tees, and specifically, to a tetherable golf tee and teeing system.

BACKGROUND

Tees have been used in the game of golf for some time now. Issues can arise when a player uses a tee to hit a golf ball because the tee can become dislodged from the ground and relocate to an undesirable resting place when the player makes a stroke at the ball sitting on the tee. Some issues can include losing the tee or the tee resting in the traveling path of golf balls for one or more other players (e.g., on a practice facility or driving range), which can cause a dangerous situation as the player attempts to retrieve his/her tee.

SUMMARY OF THE INVENTION

The present embodiment has been made in view of the above-described circumstances and aims to provide a set of golf tees that can eliminate or at least reduce one or more of the issues discussed above. To solve the above-described issues and to attain the above-described aim, a golf tee that can be tethered to another golf tee and a golf tee system including a set of golf tees that can be tethered to one another are described herein.

In one embodiment, a golf tee includes a body including a first end for inserting into an external surface and a second end opposite the first end and a crown located on the second end, the crown configured for resting a golf ball thereon. The body further includes a hollow portion and a first aperture located between the first end and the second end to access the hollow portion and for tethering the golf tee to another object. The crown includes a second aperture to further access the hollow portion.

Another golf tee includes a body including a first end for inserting into an external surface and a second end opposite the first end and a crown located on the second end, the crown configured for resting a golf ball thereon. The body further includes a first aperture and a second aperture located between the first end and the second end for tethering the golf tee to another object.

A golf tee system includes a first tee including a first body with a first end for inserting into an external surface and a second end opposite the first end and a first crown located adjacent and coupled to the second end, the first crown configured for resting a first golf ball thereon in which the first body further includes a first aperture and a second aperture. The golf tee system further includes a second tee including a second body with a third end for inserting into the external surface and a fourth end opposite the third end and a second crown located adjacent and coupled to the fourth end, the second crown configured for resting a second golf ball thereon in which the second body further includes a third aperture and a fourth aperture. The golf tee system also includes a tether including a fifth end anchorable in the first aperture and a sixth end anchorable in the third aperture.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

Figure 1A:
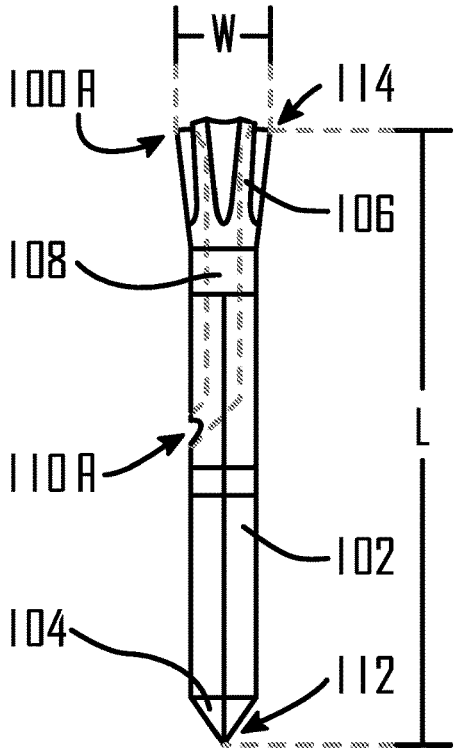
FIGS. 1A and 1B are diagrams illustrating various embodiments of a golf tee that can be tethered to another object.

In the following, a golf tee that can be tethered to another object will be described in detail on the basis of the drawings. Although constitutional elements of the present invention are generally illustrated in the drawings of the specification, it would be readily understood that the constitutional elements may be arranged and designed widely and diversely in various configurations. Accordingly, the following more detailed description on embodiments of the device does not limit the range of the present invention described in the claims and merely indicates examples of the selected embodiments of the present invention, and simply indicates the embodiments selected for the device with no confliction with the present invention described in the claims. A person skilled in the art would understand that it is possible to achieve the present invention even when one or more specific items are lost or by other components and materials. Incidentally, the present invention is not limited by this embodiment. In addition, in constitutional elements in the following embodiments, constitutional elements that the person skilled in the art is able to readily conceive of or constitutional elements which are substantially the same as the above are included.

With reference now to the drawings, FIG. 1A is a diagram of one embodiment of a golf tee 100A that can be tethered to another object. The other object to which the golf tee 100A may be tethered to can include, but is not limited to, a golf tee, a weight, a spike, and/or the like object that can maintain the golf tee 100A within a predetermined distance from the location of an external surface (e.g., the ground, a golf mat, etc.) that the golf tee 100A was inserted therein while a player played a stroke at a golf ball resting on the golf tee 100A that may result in the golf tee 100A being dislodged from the external surface. At least in the illustrated embodiment, the golf tee 100A includes, among other elements, a body element 102 (or simply body 102), an insertion element 104, a mounting element 106, and a hollow channel 108 within the body 102 extending from the mounting element 106 to an aperture 110A defined on an exterior surface the body 102.

The body 102 may include any suitable material that can support the force being applied to the golf tee 100A as it is inserted into the external surface and the weight of a golf ball as it functions as a golf tee. Example materials for the body 102 can include, but are not limited to, a natural material (e.g., wood, corn starch, bamboo, etc.), a synthetic material (e.g., a plastic, a polymer, Teflon®, nylon, etc.) and a combination of natural and synthetic materials, among other materials that are possible and contemplated herein.

As further illustrated, the body 102 can include any suitable shape and/or structure capable of performing the functions of a golf tee. At least in the illustrated embodiment, the body 102 includes a blade shape similar to a knife or gardening implement. Other suitable shapes can include, but are not limited to, a cylindrical shape, a triangular shape, a quadrilateral shape, and/or any other shape that can include the elements and functions disclosed herein.

An insertion end 104 may include any suitable shape and/or structure that can facilitate inserting the golf tee 100A into the external surface (e.g., the ground, a golf mat, etc.). In various embodiments, an insertion end 106 can include and/or define a point and/or other suitable mechanism for assisting in lodging the golf tee 100A into the external surface.

As illustrated in FIG. 1A, the insertion element 104 is located at a first end 112 of the golf tee 100A. A second end 114 of the golf tee 100A that is opposite the first end 112 may include and/or define a mounting element 106.

A mounting element 104 may include any suitable shape and/or structure that can support and/or provide a platform upon which a golf ball may rest in preparation for a player making a stroke in golf. The mounting element 104 may include the same material or a different material than the body 102.

The mounting element 104, in various embodiments, can be considered a crown for the golf tee 100A. A mounting element 104 can include an aperture 302 (see FIG. 3) below a top surface of the mounting element 104 that defines an opening to a hollow channel 108 in the body 102.

The hollow channel 108 can include any suitable shape and/or dimensions that can house and/or store a tethering apparatus. A tethering apparatus can include, but is not limited to, a leash, a tether, a cord, a harness, a rope, a string, a wire, and/or a chain, among other tethering apparatus that are possible and contemplated herein capable of tethering the golf tee 100A to another object. Further, a tethering apparatus may include any suitable material than can withstand a force applied thereto so that two or more golf tees tethered together via a tethering apparatus remain connected in response to one of the golf tees being dislodged from an external surface during a golf stroke. Suitable materials for a tethering apparatus can include, but are not limited to, nylon, a filament, a metal, a polymer, and/or a plastic, among other materials that are possible and contemplated herein.

The hollow channel 108 can extend the entirety of the golf tee 100A or any portion thereof. In various embodiments, the hollow channel 108 extends from the mounting element 106 (e.g., beginning at the aperture 302 (see FIG. 3)) to the aperture 110A.

An aperture 110A can include any suitable shape and/or dimensions that can facilitate a tethering apparatus ingressing and/or egressing the hollow channel 108 so that the tethering apparatus can be housed/stored within the hollow channel 108. In various embodiments, an aperture 110A is oriented and/or shaped downwardly toward the insertion element 104. Alternatively, the aperture 110A is oriented and/or shaped downwardly away from the mounting element 106.

In various embodiments, the upward orientation of the aperture 110A can include a downward angle with respect to a medial axis that extends between the first end 112 and the second end 114 (e.g., a negative angle along a Y-axis). The angle can include any negative angle in the range from about one degree to about ninety degrees.

The aperture 110A may be located at any height along a lateral side of the body 102. That is, an aperture 110A may be oriented in the middle of the body 102, at a position that is between the middle and the first side 112 (e.g., closer to the insertion element 104), or at a position that is between the middle and the second side 114 (e.g., closer to the mounting element 106). Being oriented and/or shaped in this manner can better hold, store, and/or house a tethering apparatus within the hollow channel 108 because the orientation/shape can create a greater amount of friction between the body 102 and the tethering apparatus than at least some other orientations/shapes.

As further illustrated in FIG. 1, a golf tee 100A includes a length L and a width W. The length L can be any suitable length than can allow the golf tee 100A to function to tee a golf ball. In various embodiments, a golf tee 100A can include a length L in the range of about one inch to about five inches, among other lengths and/or ranges of lengths that are possible and contemplated herein.

The width W (or diameter) can be any suitable width than can allow the golf tee 100A to function to tee a golf ball thereon. In various embodiments, a golf tee 100A can include a width Win the range of about a tenth inch (0.1 inches) to about one inch, among other widths and/or ranges of widths that are possible and contemplated herein.

Figure 1B:
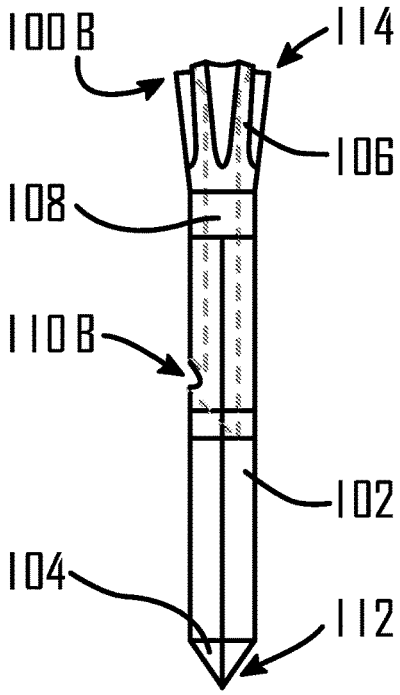

With reference to FIG. 1B, FIG. 1B is a diagram of another embodiment of a golf tee 100B that can be tethered to another object. The golf tee 100B can include a body 102, an insertion element 104, a mounting element 106, and a hollow channel 108 within the body 102 with the length L and width W similar to the golf tee 100A discussed above. At least in the illustrated embodiment, the golf tee 100B can further include an aperture 110B defined on an exterior surface the body 102 that replaces the aperture 110A.

An aperture 110B can include any suitable shape and/or dimensions that can facilitate a tethering apparatus ingressing and/or egressing the hollow channel 108 so that the tethering apparatus can be housed/stored within the hollow channel 108. In various embodiments, an aperture 110B is oriented and/or shaped upwardly toward the mounting element 106. Alternatively, the aperture 110B is oriented and/or shaped upwardly away from the insertion element 104.

In various embodiments, the upward orientation of the aperture 110B can include an upward angle with respect to a medial axis that extends between the first end 112 and the second end 114 (e.g., a positive angle along a Y-axis). The angle can include any negative angle in the range from about one degree to about ninety degrees.

The aperture 110B may be located at any height along a lateral side of the body 102. That is, an aperture 110B may be oriented in the middle of the body 102, at a position that is between the middle and the first side 112 (e.g., closer to the insertion element 104), or at a position that is between the middle and the second side 114 (e.g., closer to the mounting element 106). Being oriented and/or shaped in this manner can better hold, store, and/or house a tethering apparatus within the hollow channel 108 because the orientation/shape can create a greater amount of friction between the body 102 and the tethering apparatus than at least some other orientations/shapes.

Figure 2A:
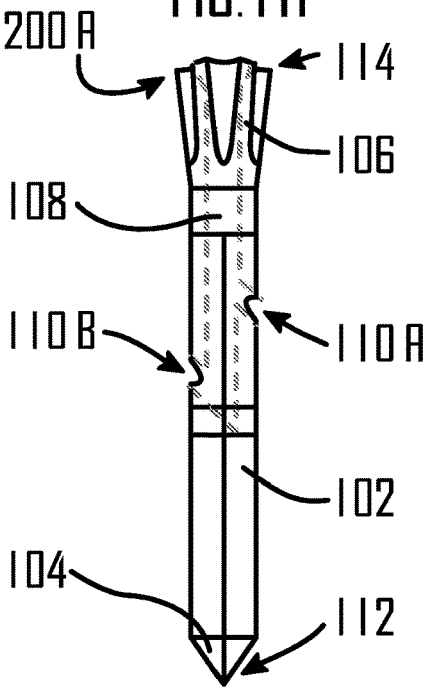
FIGS. 2A through 2E are diagrams illustrating various other embodiments of a golf tee that can be tethered to another object.

Referring to FIG. 2A, FIG. 2A is a diagram of one embodiment of a golf tee 200A that can be tethered to another object. At least in the illustrated embodiment, the golf tee 200A includes, among other elements, a body element 102 (or simply body 102), an insertion element 104, a mounting element 106, a hollow channel 108 within the body 102, and an aperture 110A defined on an exterior surface the body 102 similar to the golf tee 100A discussed above. The golf tee 200A can further include an aperture 110B defined on an exterior surface the body 102 similar to the golf tee 100B discussed above.

As illustrated in FIG. 2A, the apertures 110A and 110B can be located on different lateral sides of the body 102. In various embodiments, the apertures 110A and 110B can be located at different height along the sides of the body 102.

In the illustrated embodiment, the aperture 110A is located closer to the second side 114 (and the mounting element 106) than the aperture 110B. Further, the aperture 110B is located closer to the first side 112 (and insertion element 104) than the aperture 110A.

Figure 2B:
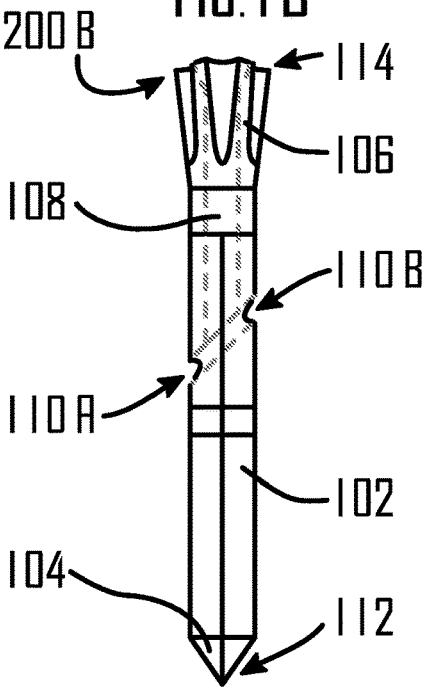

With reference to FIG. 2B, FIG. 2B is a diagram of another embodiment of a golf tee 200B that can be tethered to another object. At least in the illustrated embodiment, the golf tee 200B includes, among other elements, a body 102, an insertion element 104, a mounting element 106, a hollow channel 108 within the body, an aperture 110A, and an aperture 110B similar to the golf tee 200A discussed above.

As illustrated in FIG. 2B, the apertures 110A and 110B can be located on different lateral sides of the body 102. In various embodiments, the apertures 110A and 110B can be located at different height along the sides of the body 102.

In the illustrated embodiment, the aperture 110B is located closer to the second side 114 (and the mounting element 106) than the aperture 110A. Further, the aperture 110A is located closer to the first side 112 (and insertion element 104) than the aperture 110B.

Figure 2C:
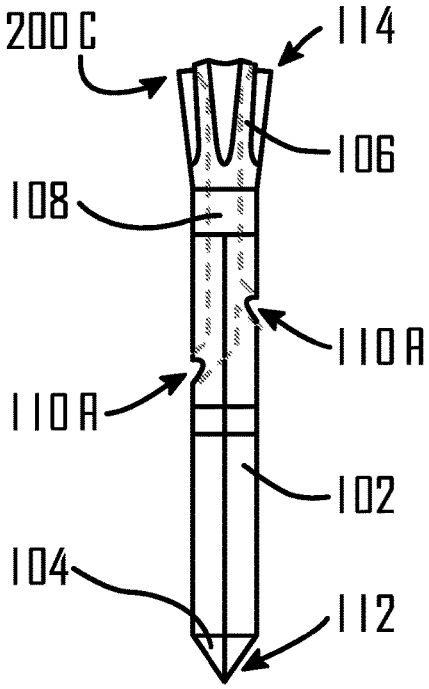

Referring to FIG. 2C, FIG. 2C is a diagram of another embodiment of a golf tee 200C that can be tethered to another object. At least in the illustrated embodiment, the golf tee 200C includes, among other elements, a body 102, an insertion element 104, a mounting element 106, a hollow channel 108 within the body, and a set of apertures 110A similar to various embodiments of discussed above.

As illustrated in FIG. 2C, at least two apertures 110A can be located on different lateral sides of the body 102. In various embodiments, the apertures 110A can be located at different height along the sides of the body 102.

In the illustrated embodiment, one aperture 110A is located closer to the second side 114 (and the mounting element 106) than the other aperture 110A. Further, the other aperture 110A is located closer to the first side 112 (and insertion element 104) than the aperture 110A.

Figure 2D:
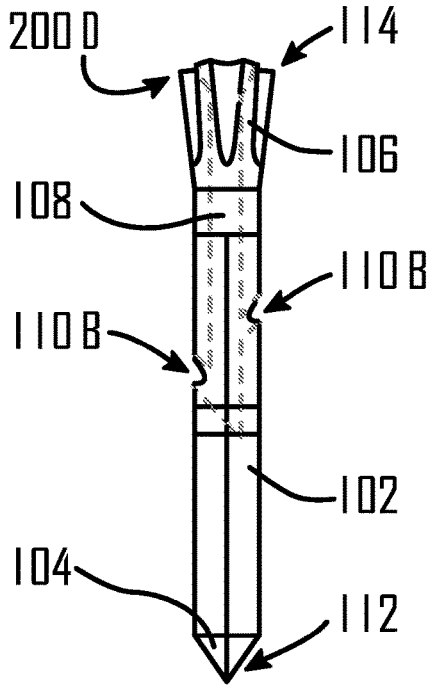

With reference to FIG. 2D, FIG. 2D is a diagram of another embodiment of a golf tee 200D that can be tethered to another object. At least in the illustrated embodiment, the golf tee 200D includes, among other elements, a body 102, an insertion element 104, a mounting element 106, a hollow channel 108 within the body, and a set of apertures 110B similar to various embodiments of discussed above.

As illustrated in FIG. 2D, at least two apertures 110B can be located on different lateral sides of the body 102. In various embodiments, the apertures 110B can be located at different height along the sides of the body 102.

In the illustrated embodiment, one aperture 110B is located closer to the second side 114 (and the mounting element 106) than the other aperture 110A. Further, the other aperture 110B is located closer to the first side 112 (and insertion element 104) than the aperture 110B.

Figure 2E:
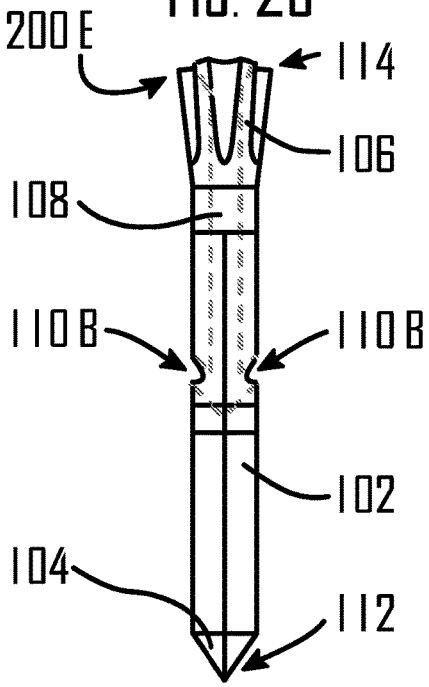

Referring to FIG. 2E, FIG. 2E is a diagram of another embodiment of a golf tee 200E that can be tethered to another object. At least in the illustrated embodiment, the golf tee 200E includes, among other elements, a body 102, an insertion element 104, a mounting element 106, a hollow channel 108 within the body, an aperture 110A, and an aperture 110B similar to the golf tee 200A discussed above.

As illustrated in FIG. 2B, the apertures 110A and 110B can be located on different lateral sides of the body 102. In the illustrated embodiment, the apertures 110A and 110B can be located at the height along the sides of the body 102, which may be any height along the sides of the body 102.

Figure 3:
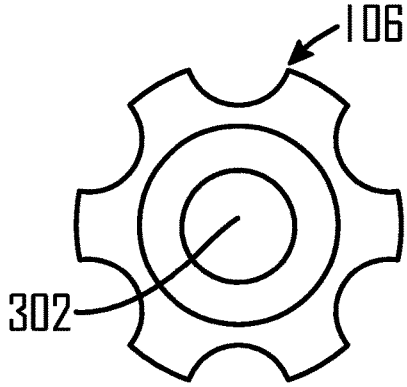
FIG. 3 is diagram illustrating a top view of the golf tees in FIGS. 1A and 1B, and 2A through 2E.

With reference to FIG. 3, FIG. 3 is a diagram of a top view of a mounting element 106. At least in the illustrated embodiment, the mounting element 106 includes, among other features, an aperture 302.

An aperture 302 can include any suitable shape and/or dimensions that can allow a tethering apparatus to ingress and/or egress the hollow channel 108 via the mounting element 106. That is, the aperture 302 can facilitate the tethering apparatus being housed/stored within the hollow channel 108.

Figure 4A:
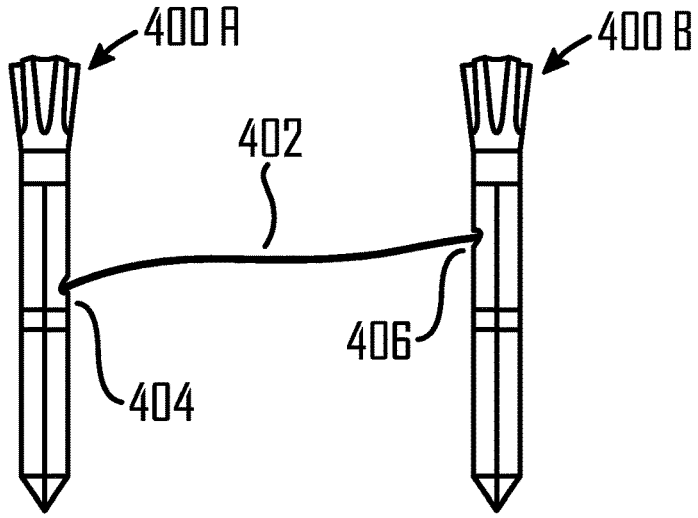
FIGS. 4A through 4C are diagrams illustrating a golf tee system for tethering a golf tee to another object.

Referring to FIG. 4A, FIG. 4A is a diagram of one embodiment of a golf tee system for tethering a golf tee to another object (e.g., another golf tee). At least in the illustrated embodiment, the golf tee system can include a golf tee 400A and a golf tee 400B tethered and/or coupled to one another via a tethering apparatus 402.

In various embodiments, a golf tee 400A may include any of the embodiments of a golf tee 100A, a golf tee 100B, a golf tee 200A, a golf tee 200B, a golf tee 200C, and a golf tee 200D discussed elsewhere herein. Further, a golf tee 400B may include any of the embodiments of the golf tee 100A, the golf tee 100B, the golf tee 200A, the golf tee 200B, the golf tee 200C, and the golf tee 200D discussed elsewhere herein.

A tethering apparatus 402 may include, but is not limited to, a leash, a tether, a cord, a harness, a rope, a string, a wire, and/or a chain, among other tethering apparatus that are possible and contemplated herein capable of tethering golf tees 400A and 400B to one another. Further, a tethering apparatus 402 may include any suitable material than can withstand a force applied thereto so that two or more golf tees tethered together via a tethering apparatus remain connected in response to one of the golf tees being dislodged from an external surface during a golf stroke. Suitable materials for a tethering apparatus can include, but are not limited to, nylon, a filament, a metal, a polymer, and/or a plastic, among other materials that are possible and contemplated herein.

In various embodiments, a tethering apparatus 402 includes a malleable material. Here, the tethering apparatus 402 can include a first end that includes a stop or in which a knot can be tied so that the tethering apparatus 402 is anchored and/or is anchorable in a hollow portion (e.g., hollow portion 108) of golf tee 400A. Similarly, the tethering apparatus 402 can include a second end that includes a stop or in which a knot can be tied so that the tethering apparatus 402 is anchored and/or is anchorable in a hollow portion (e.g., hollow portion 108) of golf tee 400B.

The golf tee 400A includes an aperture 404. In various embodiments, the aperture 404 can include an aperture 110A or an aperture 110B, as discussed elsewhere herein.

Similarly, the golf tee 400B includes an aperture 406. In various embodiments, the aperture 406 can include an aperture 110A or an aperture 110B, as discussed elsewhere herein.

At least in the illustrated embodiment, the apertures 404 and 406 can be located at different heights on their respective golf tees 400A and 400B such that apertures 404 and 406 are at different heights relative to one another. That is, aperture 404 can be located closer to an external surface (not shown) than aperture 406 when golf tees 400A and 400B are inserted into the external surface.

Figure 4B:
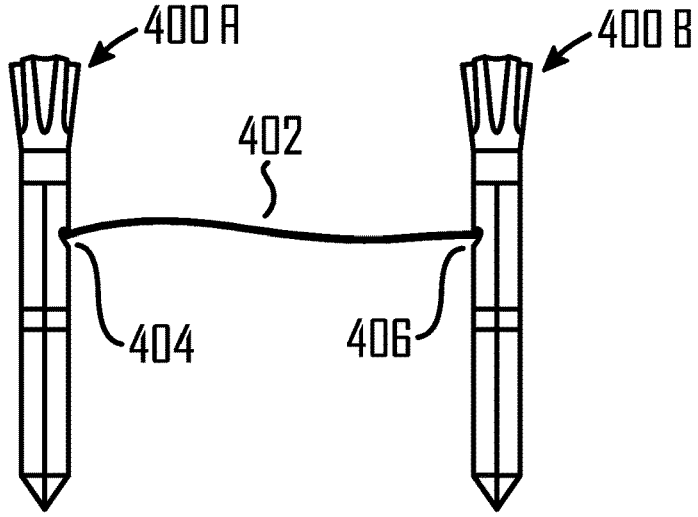

With reference to FIG. 4B, FIG. 4B is a diagram of another embodiment of a golf tee system for tethering a golf tee to another object (e.g., another golf tee). At least in the illustrated embodiment, the golf tee system can include a golf tee 400A and a golf tee 400B tethered and/or coupled to one another via a tethering apparatus 402.

In various embodiments, a golf tee 400A may include any of the embodiments of a golf tee 100A, a golf tee 100B, and a golf tee 200E discussed elsewhere herein. Further, a golf tee 400B may include any of the embodiments of the golf tee 100A, the golf tee 100B, and the golf tee 200E discussed elsewhere herein.

A tethering apparatus 402 may include, but is not limited to, a leash, a tether, a cord, a harness, a rope, a string, a wire, and/or a chain, among other tethering apparatus that are possible and contemplated herein capable of tethering golf tees 400A and 400B to one another. Further, a tethering apparatus 402 may include any suitable material than can withstand a force applied thereto so that two or more golf tees tethered together via a tethering apparatus remain connected in response to one of the golf tees being dislodged from an external surface during a golf stroke. Suitable materials for a tethering apparatus can include, but are not limited to, nylon, a filament, a metal, a polymer, and/or a plastic, among other materials that are possible and contemplated herein.

In various embodiments, a tethering apparatus 402 includes a malleable material. Here, the tethering apparatus 402 can include a first end that includes a stop or in which a knot can be tied so that the tethering apparatus 402 is anchored and/or is anchorable in a hollow portion (e.g., hollow portion 108) of golf tee 400A. Similarly, the tethering apparatus 402 can include a second end that includes a stop or in which a knot can be tied so that the tethering apparatus 402 is anchored and/or is anchorable in a hollow portion (e.g., hollow portion 108) of golf tee 400B.

The golf tee 400A includes an aperture 404. In various embodiments, the aperture 404 can include an aperture 110A or an aperture 110B, as discussed elsewhere herein.

Similarly, the golf tee 400B includes an aperture 406. In various embodiments, the aperture 406 can include an aperture 110A or an aperture 110B, as discussed elsewhere herein.

At least in the illustrated embodiment, the apertures 404 and 406 can be located at the same relative height on their respective golf tees 400A and 400B such that apertures 404 and 406 are at the same height relative to one another. That is, aperture 404 can be located at the same relative distance with respect to an external surface (not shown) as aperture 406 when golf tees 400A and 400B are inserted into the external surface.

Figure 4C:
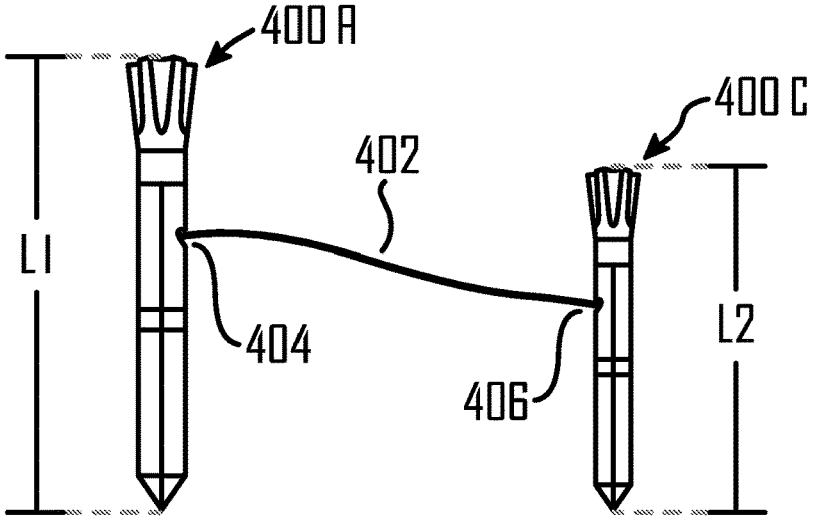

With reference to FIG. 4C, FIG. 4C is a diagram of one embodiment of a golf tee system for tethering a golf tee to another object (e.g., another golf tee). At least in the illustrated embodiment, the golf tee system can include a golf tee 400A and a golf tee 400C tethered and/or coupled to one another via a tethering apparatus 402.

In various embodiments, a golf tee 400A may include any of the embodiments of a golf tee 100A, a golf tee 100B, a golf tee 200A, a golf tee 200B, a golf tee 200C, a golf tee 200D, and a golf tee 200E discussed elsewhere herein. Further, a golf tee 400B may include any of the embodiments of the golf tee 100A, the golf tee 100B, the golf tee 200A, the golf tee 200B, the golf tee 200C, a golf tee 200D, and a golf tee 200E discussed elsewhere herein.

At least in the illustrated embodiment, golf tee 400A includes a length L1 and golf tee 400C includes a length L2, which are different lengths. Here, length L1 is greater than length L2. Length L1 can be in the range of, for example, about two inches to about five inches, inclusive, and length L2 can include a length up to about two inches, exclusive.

In various embodiments, golf tee 400A and golf tee 400C can include the same or different weights. In some embodiment, golf tee 400C can include a weight that is heavier than golf tee 400A or vice-versa so that golf tee 400A or 400C can provide a weighted anchor for the other one of golf tee 400A and 400C.

A tethering apparatus 402 may include, but is not limited to, a leash, a tether, a cord, a harness, a rope, a string, a wire, and/or a chain, among other tethering apparatus that are possible and contemplated herein capable of tethering golf tees 400A and 400B to one another. Further, a tethering apparatus 402 may include any suitable material than can withstand a force applied thereto so that two or more golf tees tethered together via a tethering apparatus remain connected in response to one of the golf tees being dislodged from an external surface during a golf stroke. Suitable materials for a tethering apparatus can include, but are not limited to, nylon, a filament, a metal, a polymer, and/or a plastic, among other materials that are possible and contemplated herein.

In various embodiments, a tethering apparatus 402 includes a malleable material. Here, the tethering apparatus 402 can include a first end that includes a stop or in which a knot can be tied so that the tethering apparatus 402 is anchored and/or is anchorable in a hollow portion (e.g., hollow portion 108) of golf tee 400A. Similarly, the tethering apparatus 402 can include a second end that includes a stop or in which a knot can be tied so that the tethering apparatus 402 is anchored and/or is anchorable in a hollow portion (e.g., hollow portion 108) of golf tee 400B.

The golf tee 400A includes an aperture 404. In various embodiments, the aperture 404 can include an aperture 110A or an aperture 110B, as discussed elsewhere herein.

Similarly, the golf tee 400C includes an aperture 406. In various embodiments, the aperture 406 can include an aperture 110A or an aperture 110B, as discussed elsewhere herein.

At least in the illustrated embodiment, the apertures 404 and 406 can be located at the same or different heights on their respective golf tees 400A and 400C such that apertures 404 and 406 are at the same or different heights relative to one another with respect to an external surface (not shown) into which golf tees 400A and 400C may be inserted.

The invention claimed is:

1. A golf tee, comprising:

a body including a first end for inserting into an external surface and a second end opposite the first end; and a crown located on the second end, the crown configured for resting a golf ball thereon, wherein:

the body further includes a first aperture and a second aperture located between the first end and the second end for tethering the golf tee to another object, the first aperture is located at a first position on the body, the second aperture is located at a second position on the body, the second position is closer to the first end than the first position, the body includes a hollow portion extending from the second end to at least the second position, and the crown includes a third aperture to access the hollow portion of the body.

2. The golf tee of claim 1, wherein:

the first aperture is angled downward toward the first end; and the second aperture is one of angled downward toward the first end and angled upward toward the second end.

3. The golf tee of claim 1, wherein:

the first aperture is angled upward toward the second end; and the second aperture is one of angled downward toward the first end and angled upward toward the second end.

4. The golf tee of claim 1, wherein:

the second aperture is located at a first position on the body;

the first aperture is located at a second position on the body;

the first position and the second position are located an equal distance from the first end;

the first position and the second position are located at different radial positions on the body;

the body includes a hollow portion extending from the second end to at least the first and second positions; and the crown includes a third aperture to access the hollow portion of the body.

5. A golf tee system, comprising:

a first tee including:

a first body with a first end for inserting into an external surface and a second end opposite the first end, and a first crown located adjacent and coupled to the second end, the first crown configured for resting a first golf ball thereon, wherein the first body further includes a first aperture and a second aperture;

a second tee including:

a second body with a third end for inserting into the external surface and a fourth end opposite the third end, and a second crown located adjacent and coupled to the fourth end, the second crown configured for resting a second golf ball thereon, wherein the second body further includes a third aperture and a fourth aperture;

a tether including a fifth end anchorable in the first aperture and a sixth end anchorable in the third aperture;

wherein:

the first aperture is located at a first position on the first body, the second aperture is located at a second position on the first body, the second position is closer to the first end than the first position, the first body includes a first hollow portion extending from the second end to at least the second position, the third aperture is located at a third position on the second body, the fourth aperture is located at a fourth position on the second body, the fourth position is one of closer to the third end than the third position and closer to the fourth end than the third position, the second body includes a second hollow portion extending from the fourth end to at least the fourth position, and the first crown includes a first aperture to access the first hollow portion of the first body.

6. The golf tee system of claim 5, wherein:

the first aperture is angled downward toward the first end; and the third aperture is one of angled downward toward the third end and angled upward toward the fourth end.

7. The golf tee system of claim 6, wherein:

the first body includes a first hollow portion extending from the second end to at least the first aperture; and the first crown includes a first aperture to access the first hollow portion of the first body.

8. The golf tee system of claim 7, wherein:

the second body includes a second hollow portion extending from the fourth end to at least the third aperture; and the second crown includes a second aperture to access the second hollow portion of the second body.

9. The golf tee system of claim 5, wherein:

the first aperture is angled upward toward the second end; and the third aperture is one of angled downward toward the third end and angled upward toward the fourth end.

10. The golf tee system of claim 9, wherein:

the first body includes a first hollow portion extending from the second end to at least the first aperture; and the first crown includes a first aperture to access the first hollow portion of the first body.

11. The golf tee system of claim 10, wherein:

the second body includes a second hollow portion extending from the fourth end to at least the third aperture; and the second crown includes a second aperture to access the second hollow portion of the second body.

12. The golf tee system of claim 5, wherein the second crown includes a second aperture to access the second hollow portion of the second body.

13. The golf tee system of claim 5, wherein the first tee and the second tee include one of different lengths and a same length.

14. A golf tee, comprising:

a body including a first end for inserting into an external surface and a second end opposite the first end; and a crown located on the second end, the crown configured for resting a golf ball thereon, wherein:

the body further includes a first aperture and a second aperture located between the first end and the second end for tethering the golf tee to another object, the second aperture is located at a first position on the body, the first aperture is located at a second position on the body, the second position is closer to the first end than the first position, the body includes a hollow portion extending from the second end to at least the second position, and the crown includes a third aperture to access the hollow portion of the body.

15. The golf tee of claim 14, wherein:

the first aperture is angled downward toward the first end; and the second aperture is one of angled downward toward the first end and angled upward toward the second end.

16. The golf tee of claim 14, wherein:

the first aperture is angled upward toward the second end; and the second aperture is one of angled downward toward the first end and angled upward toward the second end.

17. The golf tee of claim 14, wherein:

the second aperture is located at a first position on the body;

the first aperture is located at a second position on the body;

the first position and the second position are located an equal distance from the first end;

the first position and the second position are located at different radial positions on the body;

the body includes a hollow portion extending from the second end to at least the first and second positions; and the crown includes a third aperture to access the hollow portion of the body.

* * * * *